US006048029A

United States Patent [19]

Percoco

[11] Patent Number: 6,048,029

[45] Date of Patent: Apr. 11, 2000

[54] SWIVEL BEACH CHAIR

[76] Inventor: Gloria P. Percoco, 2580 Richmond Ter., Staten Island, N.Y. 10303

[21] Appl. No.: 09/256,706

[22] Filed: Feb. 24, 1999

Related U.S. Application Data

[60] Provisional application No. 60/078,296, Mar. 17, 1998.

[51] Int. Cl.[7] ..... A47C 3/02; A47C 3/026

[52] U.S. Cl. ..... 297/263.1; 297/267.1; 297/344.21; 297/268.1

[58] Field of Search ..... 297/354.13, 344.21, 297/263.1, 263.2, 264.1, 267.1, 265.1, 266.1, 268.1

[56] References Cited

U.S. PATENT DOCUMENTS

| | | | |
|---|---|---|---|
| D. 340,142 | 10/1993 | Totoro . | |
| 4,372,606 | 2/1983 | Faull | 297/265.1 X |
| 4,482,184 | 11/1984 | Mincey . | |
| 4,824,170 | 4/1989 | Goldmeier . | |
| 5,046,782 | 9/1991 | Lundeen . | |
| 5,078,451 | 1/1992 | Sobel . | |
| 5,110,184 | 5/1992 | Stein et al. . | |
| 5,427,434 | 6/1995 | Hybarger . | |
| 5,567,014 | 10/1996 | Fitch . | |
| 5,599,064 | 2/1997 | Vanderminden, Sr. . | |
| 5,611,594 | 3/1997 | Findlay . | |
| 5,839,781 | 11/1998 | Knappe . | |

FOREIGN PATENT DOCUMENTS

| | | |
|---|---|---|
| 348274 | 12/1989 | European Pat. Off. . |
| 415893 | 3/1991 | European Pat. Off. . |

*Primary Examiner*—Anthony D. Barfield
*Attorney, Agent, or Firm*—Richard C. Litman

[57] ABSTRACT

The swivel beach chair of the present invention has a chair, a base, and a rocking mechanism disposed between the chair and the base. The chair includes a back frame pivotally attached to a seat frame, the chair including a reclining mechanism for altering the inclination of the back relative to the seat from an erect position to a horizontal position. The base includes a column mounted on a swivel mechanism for rotating the chair through a full 360°. The rocking mechanism includes at least one resilient member connecting the chair to the base in order to provide a tilting movement, and may include either a travel stop mechanism to limit the degree of tilt, or an interlock system to disable the rocking mechanism when the chair back is inclined beyond a predetermined angle. In an alternative embodiment, the swivel beach chair may include a leg rest pivotally attached to the seat.

8 Claims, 4 Drawing Sheets

SWIVEL BEACH CHAIR

CROSS-REFERENCE TO RELATED APPLICATION

This application claims the benefit of U.S. Provisional Patent Application Serial No. 60/078,296, filed Mar. 17, 1998.

BACKGROUND OF THE INVENTION

1. Field of the Invention

The present invention relates to beach, deck and patio chairs, and particularly to a beach or deck chair which features a swiveling mechanism, a rocking mechanism, and an adjustable, reclining back.

2. Description of the Related Art

Beach chairs, lawn furniture, deck and patio chairs, and the like are designed for leisurely relaxation and enjoyment of the weather. Once a person has found a comfortable position, the person finds it inconvenient and uncomfortable to reposition their body, as by twisting their torso or craning their neck to maintain a conversation with another person who may be to their side or standing up. It is also inconvenient to have to arise from the chair and reposition it to face towards or away from the sun with the passage of time. A beach or deck chair which has a swivel mechanism, a rocking mechanism, and an adjustable, reclining back would be desirable.

Several devices are known which present one or two of these mechanisms, but not all three. U.S. Design Pat. No. 340,142, issued Oct. 12, 1993 to J. P. Totoro, shows a rotatable beach chair. U.S. Pat. No. 4,482,184, issued Nov. 13, 1984 to C. D. Mincey, describes a portable folding chair which includes a swivel, the swivel not being described. The chair has an adjustable back which employs a telescoping member connected to the chair arm. U.S. Pat. No. 5,611,594, issued Mar. 18, 1997 describes several improvements in the folding mechanisms of the chair described in Mincey.

U.S. Pat. No. 4,824,170, issued Apr. 25, 1989 to S. Goldmeier, teaches two swivel mechanisms for an outdoor chair. One mechanism shows a circular track with rollers having vertical legs defining an annular groove, a circular, tubular support lying in the groove, and a plate resting on the circular support, the assembly being secured by a bolt passing through the center of the plate and the track. The other swivel mechanism shows a pair of plates connected by a large diameter pivot so that the top plate swivels on the bottom plate.

U.S. Pat. No. 5,046,782, issued Sep. 10, 1991 to J. M. Lundeen, discloses a rotatable sun chair in which tubular seat supports are mounted on U-shaped brackets which have roller wheels mounted on a circular, tubular track, the track being mounted on folding legs. U.S. Pat. No. 5,078,451, issued Jan. 7, 1992 to D. J. Sobel, shows a rotatable beach chaise lounge which uses a swivel mechanism having an upper plate, a lower plate, and a plurality of ball bearings in a groove in the lower plate.

U.S. Pat. No. 5,110,184, issued May 5, 1992 to Stein, et al., describes a rotatable beach chair mounted on a cylindrical spike anchored in the ground. A ball bearing is placed in a socket between the spike and the chair seat. A second embodiment shows the cylinder attached to the seat extending into the top of the cylindrical spike with a plastic sleeve type bearing between the two. U.S. Pat. No. 5,427,434, issued Jun. 27, 1995 to K. C. Hybarger, shows a chair with a tilt and height adjustment mechanism. The tilt mechanism includes a housing mounted to a spindle, rails mounted to the underside of a chair, the housing being pivotally mounted to the rails. A load bracket is fixedly attached to the rails, and a tilt adjustment spring normally biasing the chair to an upright position is disposed between the load bracket and the housing.

U.S. Pat. No. 5,567,014, issued Oct. 22, 1996 to J. G. Fitch, teaches a folding swivel chair with a swivel mechanism which includes an upper plate, a lower plate, and a middle layer of neoprene, the upper plate and lower plates being connected by a bolt extending through a bushing in the center of the plates. U.S. Pat. No. 5,599,064, issued Feb. 4, 1997 to R. D. Vanderminden, Sr., shows a swivel rocker having a base, a chair, and a connecting unit. The base has a vertically mounted pivot pin mounted in a bearing sleeve with a bearing plate. The connecting unit has two parallel U-shaped flexure members attached to the base by a composite beam having a rectangular upper plate and a contoured lower plate. The chair seat is attached to the top legs of the U-shaped flexure members.

U.S. Pat. No. 5,839,781, issued Nov. 24, 1998 to R. D. Knape, teaches an adaptor to put a rocking chair base under a conventional four leg lawn chair. European Patent No. 348,274, published Dec. 27, 1989, teaches various mechanisms for making a folding chair in which the inclination of the back of the chair and the level of the chair seat are adjustable. European Patent No. 415,893, published Mar. 6, 1991, discloses a deck chair with an inclined and adjustable seat which may be transformed into a sun bed.

None of the above inventions and patents, taken either singularly or in combination, is seen to describe the instant invention as claimed, i.e., a beach or patio chair having a swivel mechanism, a rocking or tilting mechanism, and a back with an adjustable angle of inclination. Thus a swivel beach chair solving the aforementioned problems is desired.

SUMMARY OF THE INVENTION

The swivel beach chair of the present invention has a chair, a base, and a rocking mechanism disposed between the chair and the base. The chair includes a back frame pivotally attached to a seat frame, the chair including a reclining mechanism for altering the inclination of the back relative to the seat from an erect position to a horizontal position. The base includes a column mounted on a swivel mechanism for rotating the chair through a full 360°. The rocking mechanism includes at least one resilient member connecting the chair to the base in order to provide a tilting movement, and may include either a travel stop mechanism to limit the degree of tilt, or an interlock system to disable the rocking mechanism when the chair back is inclined beyond a predetermined angle. In an alternative embodiment, the swivel beach chair may include a leg rest pivotally attached to the seat.

Accordingly, it is a principal object of the invention to provide a beach chair with a swivel mechanism so that the chair may be rotated 360° without the necessity of standing up to reposition the chair.

It is another object of the invention to provide a beach chair with a rocking mechanism for relaxation and for tilting the chair to a more comfortable position.

It is a further object of the invention to provide a beach chair with an adjustable back for reclining the chair to a comfortable angle.

Still another object of the invention is to provide a beach or deck chair which is light-weight, functional, and provides the convenience of swivel and rocking mechanisms as well as an adjustable back.

It is an object of the invention to provide improved elements and arrangements thereof for the purposes described which is inexpensive, dependable and fully effective in accomplishing its intended purposes.

These and other objects of the invention will become readily apparent upon further review of the following specification and drawings.

DETAILED DESCRIPTION OF THE PREFERRED EMBODIMENTS

Figure 1:
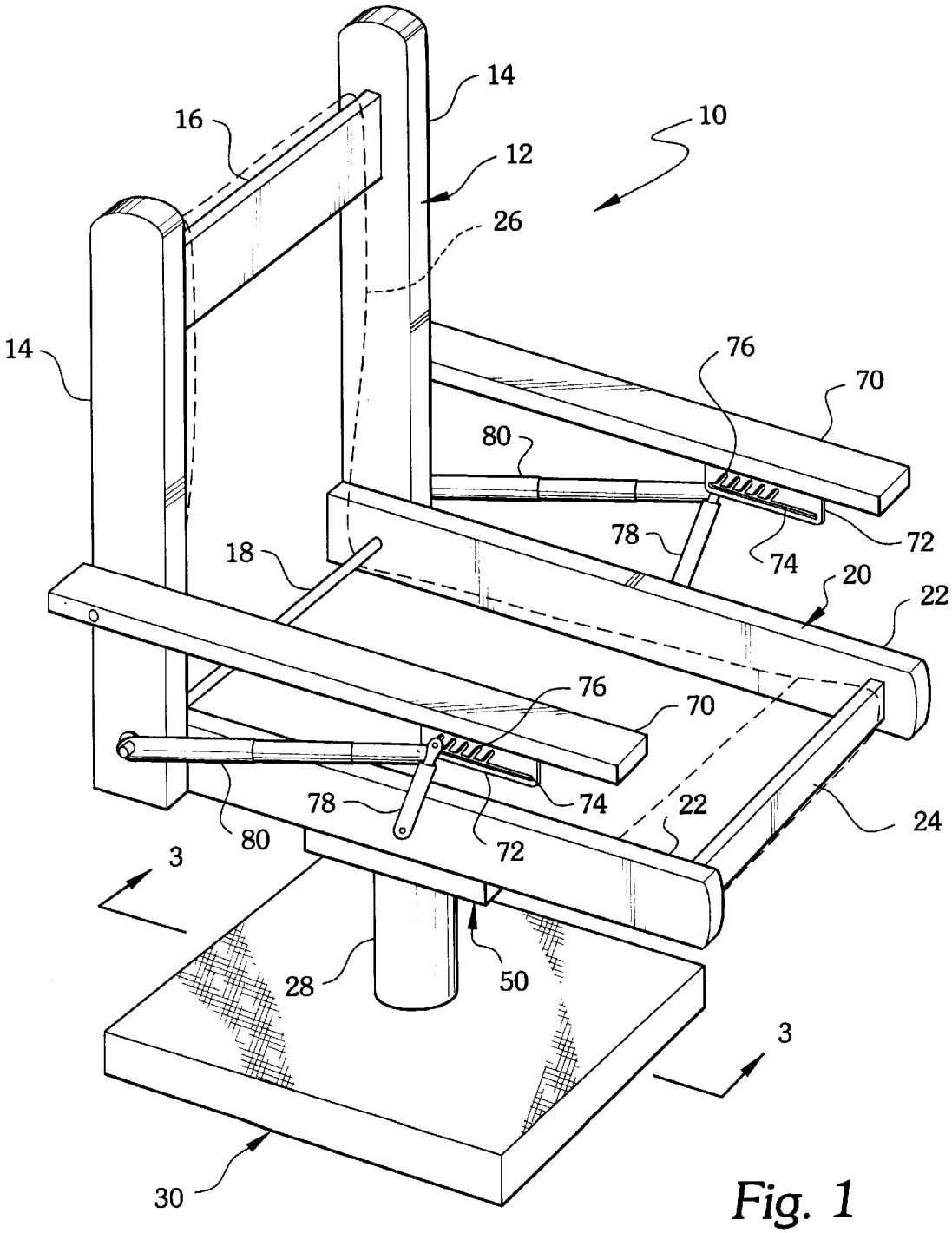
FIG. 1 is an perspective view of a beach swivel chair according to the present invention.

The swivel beach chair is designated generally as 10 in FIGS. 1 through 4. The beach chair 10 includes a chair having a back 12 pivotally connected to a seat 20. The frame of the back 12 has two side members 14 and at least one cross member 16. The frame of the seat 20 also has two side members 22 and at least one cross member 24. The back frame 12 and the seat frame 20 are joined by a pivot rod 18, so that the back frame 12 forms a generally rectangular frame defined by the opposing side members 14, the cross member 16 and the rod 18, and so that the seat frame 20 forms a generally rectangular frame defined by the opposing side members 22, the cross member 24 and the rod 18, the rod 18 forming a common side about which the two frames 12, 20 pivot.

The frame members 14, 16, 22, and 24 may be solid and made from a light weight wood, or they may be hollow, tubular and made from light weight aluminum, or from any other materials conventionally used in constructing furniture for beach or outdoor use. The pivot rod 18 is preferably made from metal. The back 12 and seat 20 frames may be covered by a flexible covering, such as canvas 26 (shown in phantom in FIG. 1), by a synthetic upholstery webbing material, by seat cushions supported by a plurality of cross members, , by a plurality of relatively rigid slats made from a thermoplastic material, or by any other conventional outdoor furniture material. Optionally, the chair may include a leg rest 27, as shown in FIG. 2.

Figure 2:
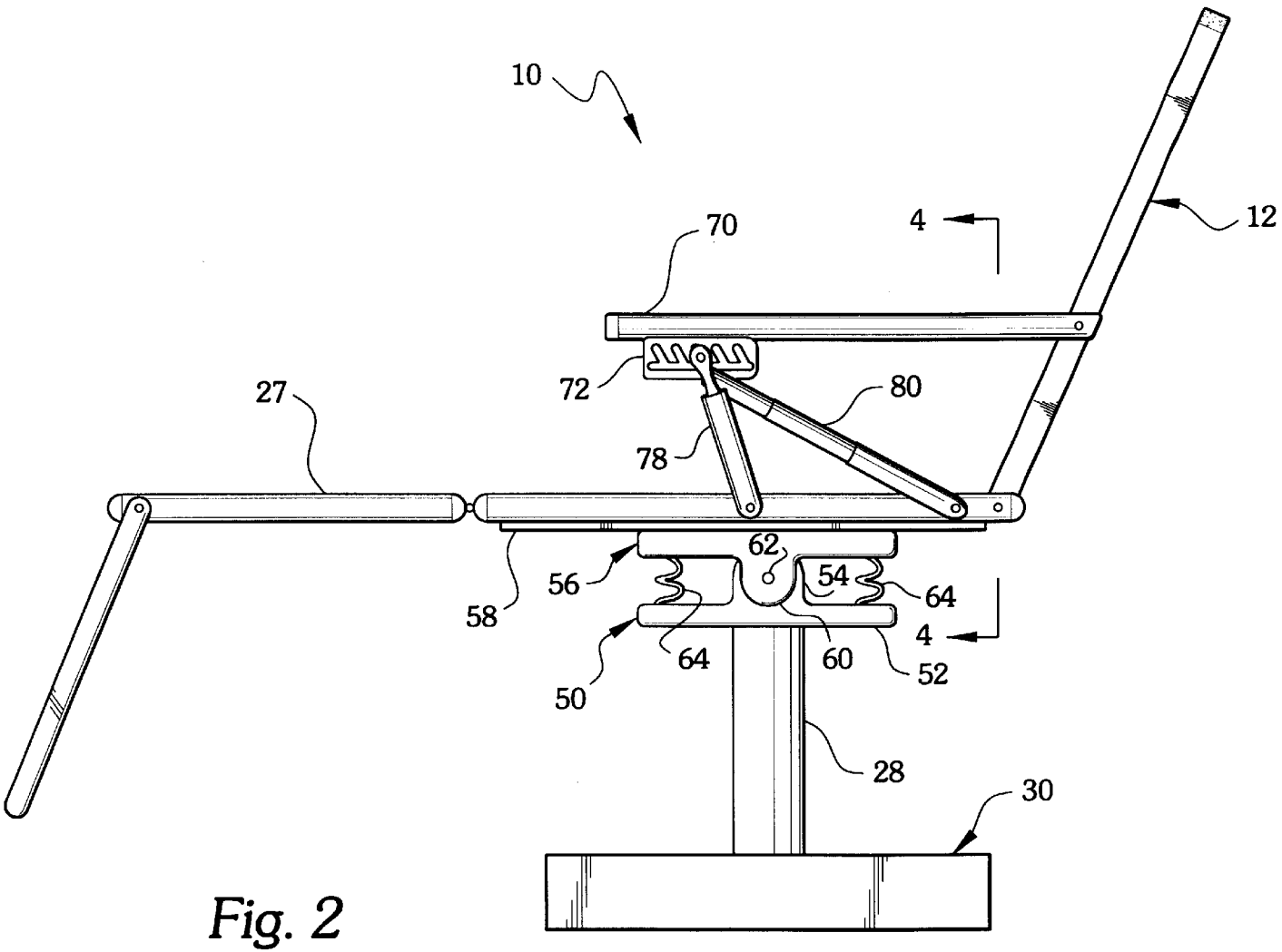
FIG. 2 is a side view of a beach swivel chair according to the present invention.
Figure 3:
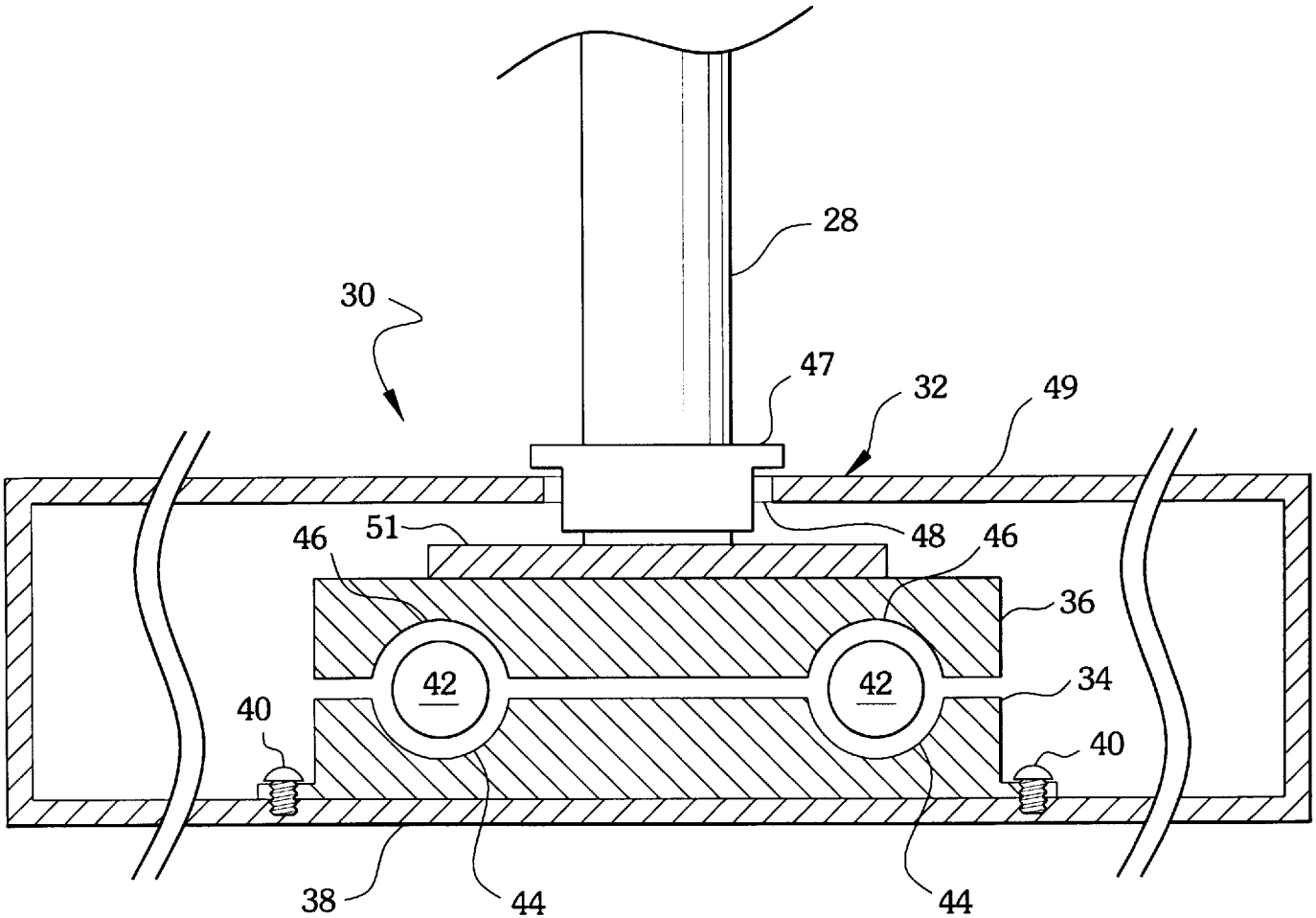
FIG. 3 is a section view along the line 3—3 of FIG. 1.

As shown in FIG. 2. the seat 20 is connected to a swivel base 30 by a rocking mechanism 50 mounted on a cylindrical column 28. Several mechanisms for connecting a chair seat to a base by a swiveling or rotating column are known in the prior art. FIG. 3 illustrates one form of a swivel mechanism which may be used in the swivel beach chair 10 of the present invention. The swivel base 30 includes a generally rectangular box type housing 32. A pair of circular, disk-shaped plates 34, 36 are enclosed within the housing 32. The lower plate 34 is secured to the bottom wall 38 of the housing 32, as by a plurality of screws 40. The upper plate 36 is mounted above the lower plate 34, spaced apart by a plurality of ball bearings 42 disposed within annular grooves or bearing races 44, 46 defined in the lower 34 and upper 36 plates respectively. The column 28 extends through a bushing 47 in an aperture 48 defined in the top wall 49 of the housing 32 and is fixedly attached to the upper plate 36 by a mounting plate 51 which may be welded or secured by screws.

It will be understood that the swivel base 30 shown in FIG. 3 is by way of illustration, and not by way of limitation. Other swivel mechanisms may be used conformably with the present invention. For example, the swivel mechanism may comprise a single ball bearing which mates with a socket at the base of the column, a frictionless plastic sleeve which received a cylinder at the base of the column, a frictionless plastic or synthetic disc attached to the base of the column, or any other conventionally known means for rotatably supporting a column. Advantageously, the swivel base 30 is enclosed within a housing 32 to protect the ball bearing mechanism from dirt, sand, and other contaminants which might obstruct the mechanism. The swivel base 30 permits the chair 10 to be rotated through a full 360° about a vertical axis concentric with the column 28 for added convenience. The swivel base 30 may optionally be mounted on a plurality of legs (not shown), which may be fixedly to the housing 32, or which may be hingedly attached to the housing 32 so that they may be folded for storage.

Similarly, there are many forms of rocking or tilting mechanisms known in the art adapted for mounting to the top of a chair column. A generic rocking mechanism 50 is shown in FIG. 2. The rocking mechanism 50 has a rectangular plate 52 mounted at the top of the column 28. The plate 52 has a pair of parallel ears 54 (one of which is shown in FIG. 2, the other ear being symmetrically disposed on the opposing side of the plate 52) projecting upwards from opposing sides of the plate 52, the ears 54 having aligned apertures defined therein. An upper, rectangular plate 56 is mounted on a rectangular plate 58 fixedly attached to the seat frame 20. The upper plate 56 has a pair of parallel ears 60 (one of which is shown in FIG. 2, the other ear being symmetrically disposed on the opposing side of the plate 56) depending from opposing sides of the plate 56, the ears 60 having aligned apertures defined therein. The upper plate 56 is connected to the lower plate 52 by a pivot pin 62 inserted through the aligned apertures of the ears 54, 60, so that the chair seat 20 pivots on the pivot pin 62. A pair of balanced, helically wound coil springs 64 are attached between the upper 56 and lower 52 plates in front of and behind the juncture of the column 28 with the seat 20 in order to bias the seat 20 in a normally horizontal position. The spring constant of the springs 64 is normally high enough to impart sufficient stiffness to the springs 64 that it requires some effort to tilt or rock the chair 10.

It will be apparent that other forms of rocking mechanisms may be used with the swivel beach chair 10 of the present invention. The rocking mechanism 50 may comprise leaf springs or other flexible members attached between the column 28 and the seat 20 in accordance with the present invention, the construction details of the rocking mechanism 50 not being critical to the invention as claimed. The rocking mechanism 50 may further comprise means for limiting the degree of travel of the rocking mechanism 50, means for damping any oscillation caused by the springs 64, or a locking mechanism for preventing the chair 10 from rocking with the back 12 of the chair 10 fully reclined.

Figure 4:
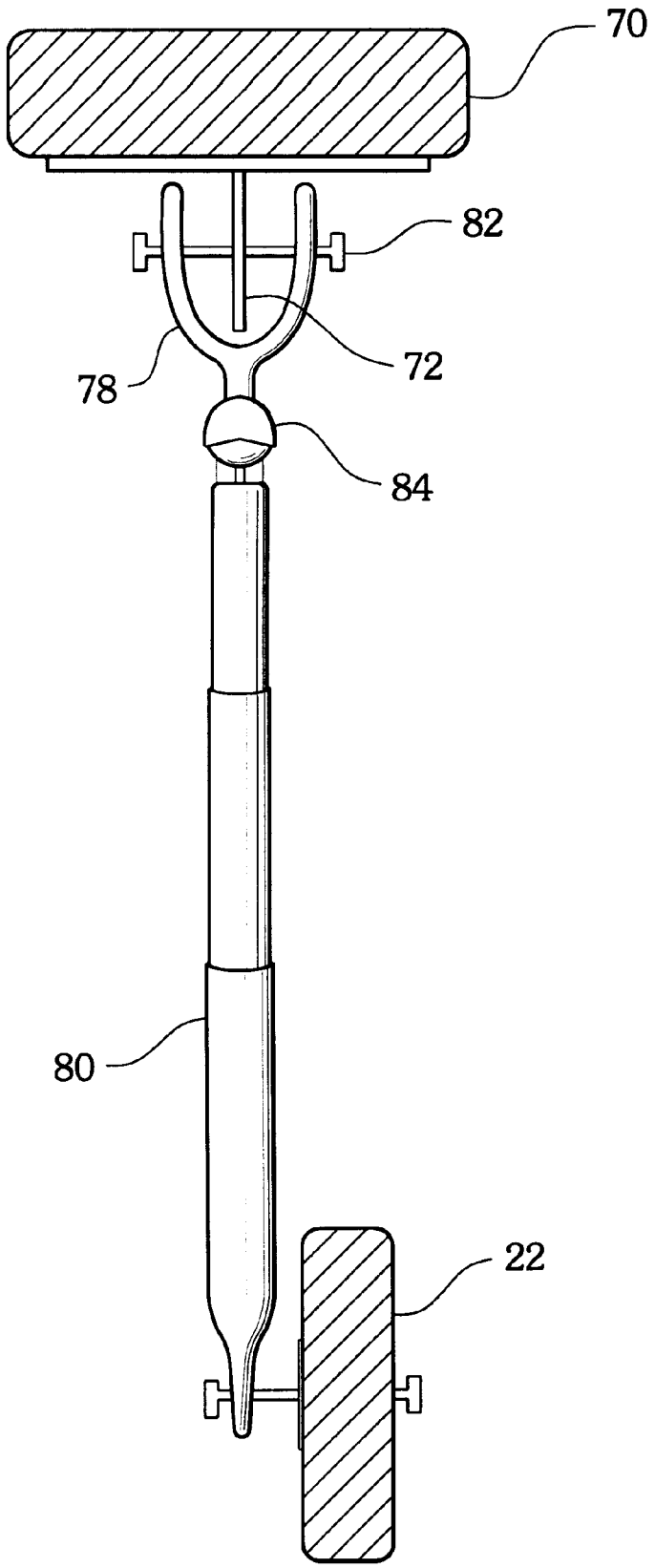
FIG. 4 is a section view along the line 4—4 of FIG. 2.

The swivel beach chair 10 also includes means for adjusting the angle of inclination between the back 12 and the seat 20 from about 90° through about 180°. The means for adjusting the angle of inclination of the back 12 may comprise any conventionally known means for adjusting the inclination of the back of a beach or patio chair. One method of combining a back adjustment mechanism with a swivel base 30 and rocking mechanism 50 is shown in FIGS. 1, 2 and 4.

The beach chair 10 includes a pair of armrests 70 pivotally connected to the opposing side members 14 of the back 12. The armrests 70 each have an adjustment plate 72 depending from the bottom of the armrests 70. The adjustment plates 72 have an elongated slot 74 defined therein, the elongated slot having a plurality of vertically oriented notches 76 arising therefrom. The armrests 70 are supported by a first 78 and second 80 arm support member. The first support members 78 are pivotally attached at one end to the middle or front portion of the seat side members 22. The opposite ends of the first support members 78 are bifurcated, as shown in FIG. 4, the forks being disposed on opposite sides of the adjustment plate 72. A pin 82 is disposed between the forks of the first support member 78, the pin being slidably disposed within the slot 74 and adapted for engaging the notches 76.

The second support arms 80 have a first end pivotally attached to either the rear portion of the side member 22 of the seat 20, adjacent its point of attachment to the pivot rod 18, as shown in the Figures. The opposite end of the second support arm 80 is pivotally attached to the first support arm 78 adjacent to the bifurcated end of the arm 78, as by a ball and socket joint 84. Both the first 78 and second 80 support arms are telescoping, so that the length of the arms 78, 80 is extensible.

Operation of the back adjustment means is entirely conventional. When the pin 82 is inserted into the rearward notch 76, the length of the first 78 and second 80 support arms are fixed, their intersection forming the apex of a triangle whose base is the side member 22. The rigid triangular shape firmly supports the armrest 70 and locks the angle between the back 12 and the seat 20 at about 90°. The angle of inclination is adjusted by sliding the pin 82 out of the notch 76 and along the slot 74, either to another notch 76, or to the end of the elongated slot 74. At the end of the elongated slot 74, the first 78 and second 80 support arms pivot to become parallel with the side member 22, the angle between the seat 20 and the back 12 being about 180°. A stop (not shown) may be fixed to the side member 22 to prevent the support arms from rotating further than a position parallel to the side members 22. When the pin 82 is inserted into a notch 76 in an intermediate position, the support arms 78, 80 are again fixed in length to form a rigid triangle, supporting the armrests 70 and locking the angle of inclination of the back 12.

It will be apparent that other means of adjusting the angle of inclination of the back 12 of the swivel beach chair 10 and locking the back 12 in position may be devised, including variations in the means of connecting the first 78 and second 80 support arms, consistent with the disclosed invention, the invention comprising the combination of a swivel mechanism, a rocking mechanism, and means for adjusting the angle of inclination of the back of the chair.

It is to be understood that the present invention is not limited to the embodiments described above, but encompasses any and all embodiments within the scope of the following claims.

What is claimed is:

1. A swivel beach chair, comprising:

a) a back frame having a pair of opposing side members and a cross member disposed between the side members;

b) a seat frame having a pair of opposing side members and a cross member disposed between the side members;

c) a pivot rod pivotally attaching said back frame to said seat frame so that said back frame and said seat frame each form a substantially rectangular frame, said pivot rod being a side common to both frames;

d) a swivel base having swivelling means for rotating the swivel beach chair 360° about a vertical axis;

e) a rocking mechanism attached to said swivel base, said seat frame being mounted on said rocking mechanism, the rockin mechanism having rocking means for pivoting said seat frame about a horizontal axis;

f) a pair of armrests pivotally attached to the side members of said back frame; and g) reclining means for adjusting the angle of inclination between said back frame and said seat frame from an erect position in which the planes in which said back frame and said seat frame are disposed define an angle of about 90°, to a reclining position in which the planes define an angle of about 180°, said reclining means including:

a pair of first support arms, the arms having a first end and a second end, the first end being pivotally attached to the opposing side members of said seat frame;

a pair of second support arms having a first end and a second end, the first end being pivotally attached to the opposing side members of said seat frame and the second end being attached to said first support arms;

a pair of adjustment plates depending from said armrests, the adjustment plates having an elongated slot defined therein and a plurality of vertically oriented notches arising from the slot; and a pin disposed at the second end of said first support arm, said pin being slidably disposed in said slot and adapted for engaging said notches.

2. The swivel beach chair according to claim 1, wherein said swivel base further comprises a housing, the housing enclosing said swivelling means.

3. The swivel beach chair according to claim 2, wherein said swivelling means further comprises a cylindrical column and at least one bearing, said column being mounted on said bearing, said bearing being enclosed within said housing, and said column extending through said housing.

4. The swivel beach chair according to claim 1, wherein said rocking means further comprises at least one resilient member.

5. The swivel beach chair according to claim 4, wherein said at least one resilient member comprises a coil spring.

6. The swivel beach chair according to claim 1, wherein said first and second support arms further comprise telescoping sections, whereby the length of said support arms is extensible.

7. The swivel beach chair according to claim 1, wherein said back frame and said seat frame are made from wood.

8. The swivel beach chair according to claim 1, wherein said back frame and said seat frame are made from aluminum.

* * * * *